US010864405B2

(12) United States Patent
Pulliam

(10) Patent No.: US 10,864,405 B2
(45) Date of Patent: Dec. 15, 2020

(54) EXERCISE BAR WITH HEXAGONAL GRIP

(71) Applicant: Larry Pulliam, Santa Cruz, CA (US)

(72) Inventor: Larry Pulliam, Santa Cruz, CA (US)

( * ) Notice: Subject to any disclaimer, the term of this patent is extended or adjusted under 35 U.S.C. 154(b) by 26 days.

(21) Appl. No.: 15/802,452

(22) Filed: Nov. 3, 2017

(65) Prior Publication Data

US 2019/0134455 A1 May 9, 2019

(51) Int. Cl.

| | |
|---|---|
| ***A63B 21/00*** | (2006.01) |
| ***A63B 21/072*** | (2006.01) |
| ***A63B 23/12*** | (2006.01) |
| ***A63B 1/00*** | (2006.01) |
| ***A63B 21/068*** | (2006.01) |
| ***A63B 21/16*** | (2006.01) |

(52) U.S. Cl.

CPC ..... *A63B 21/4035* (2015.10); *A63B 1/00* (2013.01); *A63B 21/00047* (2013.01); *A63B 21/068* (2013.01); *A63B 21/072* (2013.01); *A63B 21/0724* (2013.01); *A63B 21/0726* (2013.01); *A63B 21/169* (2015.10); *A63B 23/1218* (2013.01); *A63B 2209/00* (2013.01)

(58) Field of Classification Search

CPC ... A63B 1/00; A63B 21/00047; A63B 21/068; A63B 21/0726; A63B 21/0724; A63B 21/072; A63B 21/4035; A63B 21/169; A63B 23/1218; A63B 2209/00

See application file for complete search history.

(56) References Cited

U.S. PATENT DOCUMENTS

| | | | | |
|---|---|---|---|---|
| 5,269,516 | A * | 12/1993 | Janes | A63B 49/08 473/523 |
| 7,048,678 | B2 * | 5/2006 | Harms | A63B 21/0728 482/107 |
| 9,005,088 | B2 * | 4/2015 | Sides, Jr. | A63B 21/0618 482/106 |
| 9,132,315 | B1 * | 9/2015 | Chen | A63B 23/12 |
| 10,159,868 | B2 * | 12/2018 | Light | A63B 21/4049 |
| 2007/0027007 | A1 * | 2/2007 | Frasco | A63B 21/0726 482/106 |
| 2008/0220952 | A1 * | 9/2008 | Yang | A63B 21/072 482/107 |

* cited by examiner

*Primary Examiner* — Megan Anderson
(74) *Attorney, Agent, or Firm* — Patrick Reilly

(57) ABSTRACT

A device and method of use thereof provide a gripping element having a hexagonal cross-section. A weightlifting bar having a hexagonal circumference forming non-circular, substantively planar surfaces enables weight training. A pull up bar or other bar attached to a structure, wherein the gripping surface has a hexagonal circumference forming six surfaces enables gymnastic exercise. A kettle bell, a dumbbell and/or barbell exercise equipment each present a hexagonal circumference forming six planar surfaces. A structure or equipment presenting the gripping element may include knurled portions and/or smoothed portions. The gripping element may be positioned on a curved bar.

8 Claims, 11 Drawing Sheets

EXERCISE BAR WITH HEXAGONAL GRIP

FIELD OF THE INVENTION

The present invention relates to manual gripping of structures and weighted objects. More particularly, the present invention relates manually accessible grip elements of fixed structures and manually positionable weighted objects.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Numerous structures and objects, such as ladders, pull up bars and weight training equipment, are intended to manually engaged with by human users. The trend in the prior art is to manufacture gripping elements of such structures to be consistently smooth throughout a round circumference, or to present a consistent surface texture, such as a knurled surfacing. The prior art teaches that such consistency is preferable for cost efficiency and standardization. In one prior art example, competitive weight lifting associations might specify the exact dimensions and weight of weight lifting bar for authorized use in competitions. The prior art teaches that in training for competition it is generally preferred to use the same equipment design that a competitor will be using in an authorized match, meet or competition. When standardized gripping elements are specified to have a continuous circumference, the prior art teaches against even training with a bar that might have an uneven, broken, or inconsistent gripping circumference.

The prior art fails to consider or provide a gripping element intended for manual gripping by a human user that is superior to prior art grips that form a consistent surface throughout an entire circumference of the prior art grip element of the equipment or structure.

SUMMARY AND OBJECTS OF THE INVENTION

Towards these and other objects of the present invention (hereinafter, "the invented grip") that are made obvious to one of ordinary skill in the art in light of the present disclosure, the invented grip.

One preferred embodiment of the invented grip presents a hexagonal cross-section. An alternate preferred embodiment of the invented grip is comprised within a weightlifting bar having a hexagonal circumference forming non-circular, substantively planar surfaces enables weight training.

A still alternate preferred embodiment of the invented grip provides a pull up bar or other bar attached to a structure, wherein the gripping surface of the instant bar has a hexagonal outer surface forming six surfaces.

A yet alternate preferred embodiment of the invented grip provides kettle bell, a dumbbell and/or barbell exercise equipment that each present a hexagonal outer circumference forming six planar surfaces. The invented grip may optionally be positioned on a curved bar.

A structure or equipment presenting the invented grip may include knurled portions and/or smoothed portions.

Various alternate preferred embodiments of the invented grip include one or more of the following aspects or elements: (a.) an elongate length forming a hexagonal cross-section along first length; (b.) a first attachment end and a second attachment end positioned at separate ends of the elongate length; (c.) the first attachment end and/or the second attachment end each presenting circular cross-sections; (d.) a first attachment end and/or a second attachment end each conforming to a standard weight lifting sleeve specification of the International Olympic Committee of Lausanne, Switzerland or other suitable equipment standards known in the art; (e.) second elongate length forming a hexagonal cross-section; (f.) a first length and a second length symmetrically positioned relative to a central point of a same elongate length; (g.) a first length and the second length each extending within the range of from four inches to eight inches along the elongate length; (h.) a first length and a second length each extending greater than eight inches along the elongate length; (i.) a knurled surface extending partially or fully along an outer surface of an elongate length; (j.) a first smooth ring portion is disposed within a knurling of a first length and a second smooth ring portion disposed within a second length; (k.) a linear relieved section partially extending along a face of the hexagonal elongate length; (l.) one or more linear relieved sections, each linear relieved section at least partially extending along a separate face of a hexagonal elongate length; (m.) at least one linear relieved section, the at least one linear relieved section partially extending along a face of a hexagonal elongate length; (n.) a hexagonal elongate bar conforming to elements of a standard weight lifting equipment specification; (o.) a weighted kettle bell comprising a curved handle coupled to ta weight at both a first attachment point and a second attachment point, wherein the curved handle includes a hexagonal cross-section; (p.) a kettle bell handle length extending for less than one half of a full length of a curved kettle bell handle; (q.) a kettle bell handle length extending for greater than one half of a full length of a curved kettle bell handle; (r.) An exercise pull-up bar coupled with an external structure forming a hexagonal cross-section along at a first length.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims. Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1A:
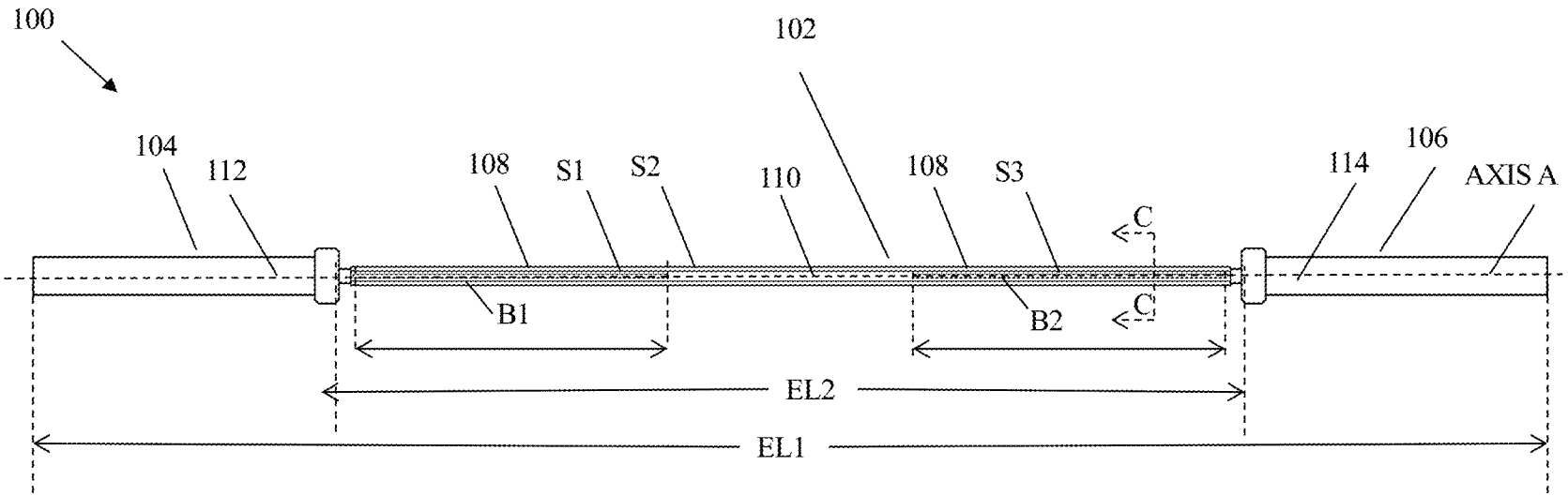
FIG. 1A is a front view of a barbell assembly according to a first embodiment of an invented barbell; wherein the barbell assembly comprises the barbell and bar sleeves; wherein the barbell comprises hexagonal sides and relieved sections.

Referring now generally to the Figures particularly to FIG. 1A, FIG. 1A is a front view of a barbell assembly 100 according to a first embodiment of an invented barbell 102 featuring (a.) a pair of bar sleeves 104 and 106, and (b.) slots 108 that have been formed by extrusion, stamping, molding, etching, milling, relieving or other suitable construction method known in the art on every other of the six hexagonal sides S1-S6 along axis A. A registration band 110 may be used for calibration purposes between optionally knurled sections B1 and B2. End points 112 and 114 support weight, and the designator C indicates where the side view of FIG. 1B has been taken.

The invented barbell 102 may be or comprise a metal or metal alloy, such as iron, aluminum, steel and/or other suitable metal, metal alloy, and/or nonmetallic material known in the art. The invented barbell 102 may be manufactured by extrusion, stamping, molding, etching, milling, relieving and/or other suitable construction methods and means known in the art.

It is understood that all side views of the present disclosure refer to dimensions and measurements taken in planes that are normal to the axis A.

The invented barbell 102 preferably weighs 20 kg and presents a total maximum elongate length EL1 parallel to the axis A of 2200 mm or alternatively of 7 feet and two inches.

The invented barbell 102 preferably additionally presents an inner elongate length EL2, also in parallel to the axis A, of 1310 mm between the pair of bar sleeves 104 & 106.

Figure 1B:
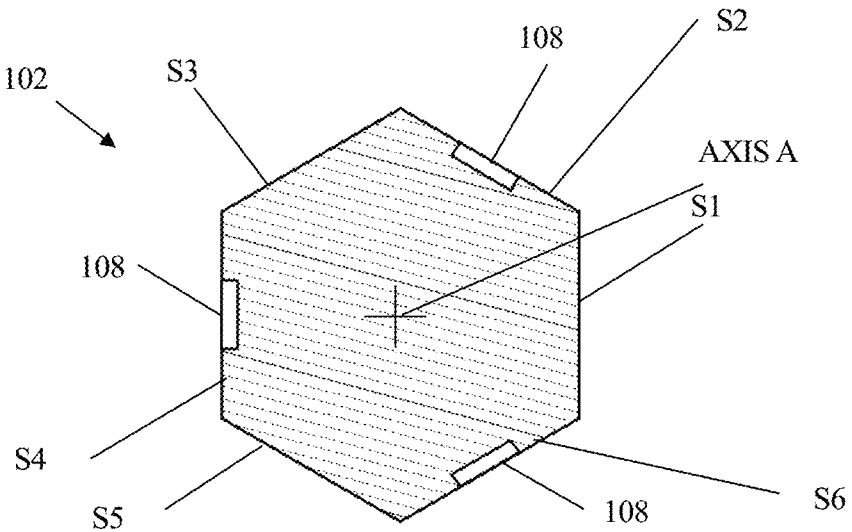
FIG. 1B is a cutaway side-view of the invented barbell of FIG. 1A.

Referring now generally to the Figures and particularly to FIG. 1B, FIG. 1B is a cutaway side-view of the invented barbell 102.

Figure 1C:
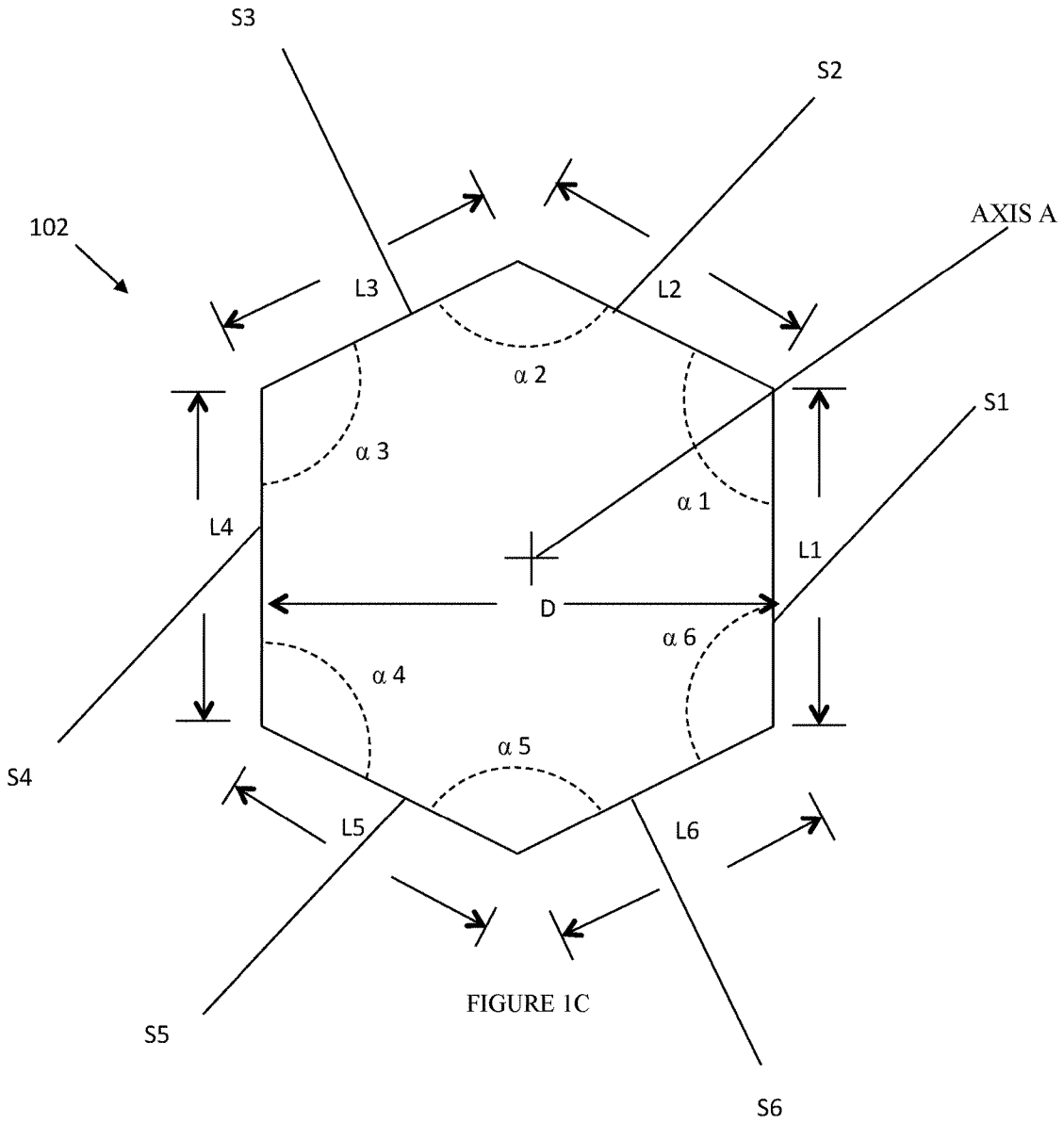
FIG. 1C is a cutaway side view of the angles within the invented barbell of FIG. 1A.

Referring now generally to the Figures and particularly to FIG. 1C, FIG. 1C is a detailed cutaway side view of the invented barbell 102. First side S1 through sixth side S6 each have a corresponding side length wherein each length L1-L6 preferably varies in length no more than 2% from any other length L1-L6. The lengths L1-L6 are preferably within the range of 0.25 inches to 3.0 inches and more preferably within the range of 28 mm to 31 mm. Any two sides S1-S6 of the invented barbell 102 define an internal angle alpha $\alpha$1-$\alpha$6 wherein any angle $\alpha$1 to $\alpha$6 preferably diverges in magnitude from any other $\alpha$1 to $\alpha$6 no more than 1 degree.

In certain preferred embodiments of the present invention, the invented barbell 102 and sleeves 104 & 106 each conform to the equipment standards of the International Olympic Committee of Lausanne, Switzerland. In one alternate preferred embodiment, the invented barbell 102 weighs 20 kg and presents a maximum shaft diameter D of 28 mm or alternatively a maximum shaft diameter D within the range of from 27 mm to 31 mm. In other alternate preferred embodiments, the invented barbell 102 presents a 28 mm shaft diameter and a maximum total elongate length EL1 of 2200 mm. In another alternate preferred embodiment, the invented barbell weighs 15 kg and has a maximum shaft diameter D of 25 mm and a maximum total elongate EL1 a length of 2010 mm. The distance between the sleeves 104 & 106 of the inner elongate length EL2 may be at 1310 mm for both a men's bar embodiment and a women's bar embodiment. It is understood that the diameter D is measured within a plane that is normal to the axis A.

Figure 2A:
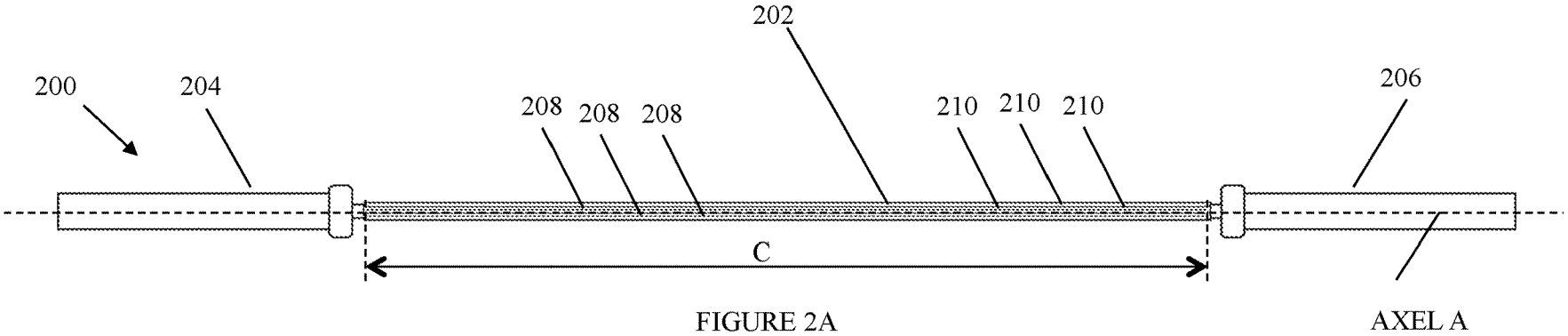
FIG. 2A is a front view of a barbell assembly according to a second preferred embodiment of an invented barbell; wherein the relieved sections extend the entire length of the barbell.

Referring now generally to the Figures and particularly FIG. 2A, FIG. 2A is a front view of a second barbell assembly 200 according to a second preferred embodiment of a second invented barbell 202 where additional weight may be mounted upon a pair of second bar sleeves 204 & 206. These two second bar sleeves 204 & 206 cap the ends of a set of three second relieved sections 208 and a corresponding plurality of second hexagonal sides 310 extending the entire length of optionally knurled section C.

Figure 2B:
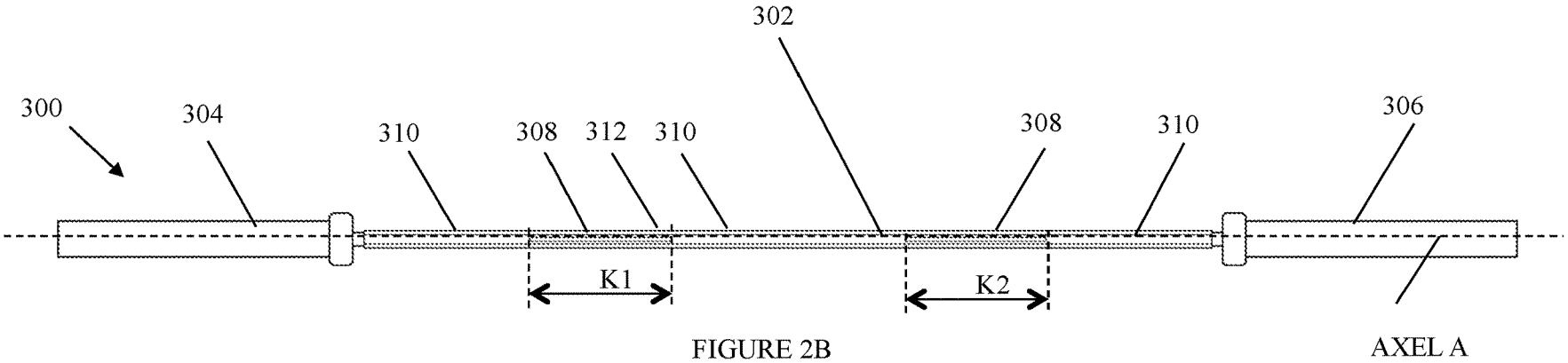
FIG. 2B is a front view of a barbell assembly according to a third preferred embodiment of an invented barbell; wherein the relieved section covers hand-size lengths of the barbell.

Referring now generally to the Figures and particularly to FIG. 2B, FIG. 2B is a front view of a third barbell assembly 300 according to a third preferred embodiment of a third invented barbell 302. A pair of third bar sleeves 304 and 306 frame the third invented barbell 302 wherein a plurality of third relieved sections 308 in their separate places cover a hand-size length of the third invented barbell 302 at knurled sections K1 and K2. Six third hexagonal sides 310 are featured throughout. Three second registration bands 312 are featured for calibration.

Figure 3A:
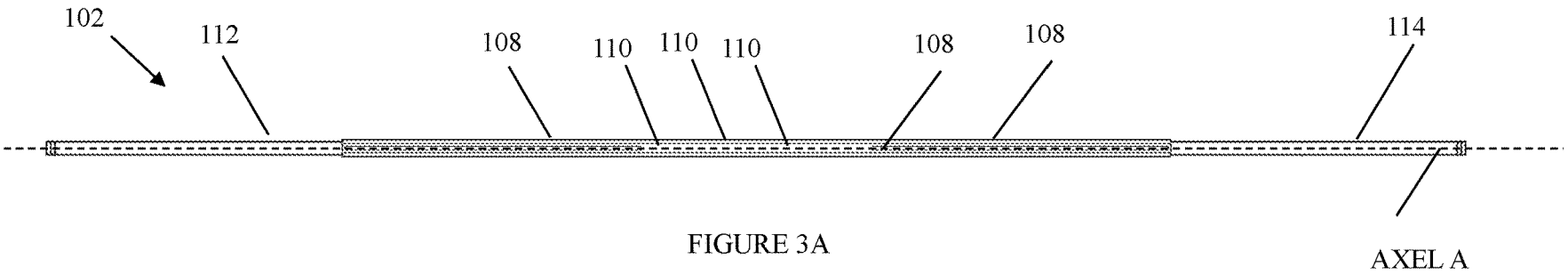
FIG. 3A is a front view of the first preferred embodiment of the invented barbell of the FIG. 1A.

Referring now generally to the Figures and particularly to FIG. 3A, FIG. 3A is a front view of the first preferred embodiment of the first invented barbell 102 includes a clear view of the end points to support the barbell assembly and sleeves 104 & 106 of FIG. 1A.

Figure 3B:
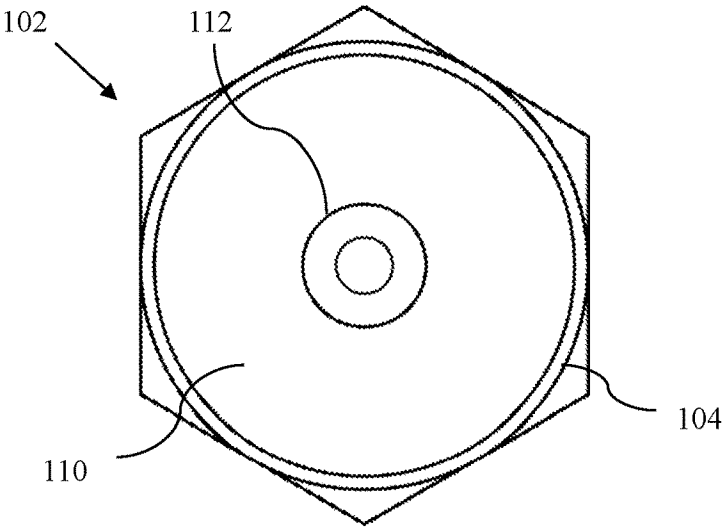
FIGURE 3B (PRIOR ART)
FIG. 3B is a side view of the first preferred embodiment of the invented barbell of the FIG. 1A.

Referring now generally to the Figures and particularly to FIG. 3B, FIG. 3B is a prior art modular application where a side view of the first preferred embodiment of the first invented barbell 102 of the FIG. 1A where the hexagonal grip alternately or additionally works in conjunction with while also improving upon existing equipment.

Figure 4A:
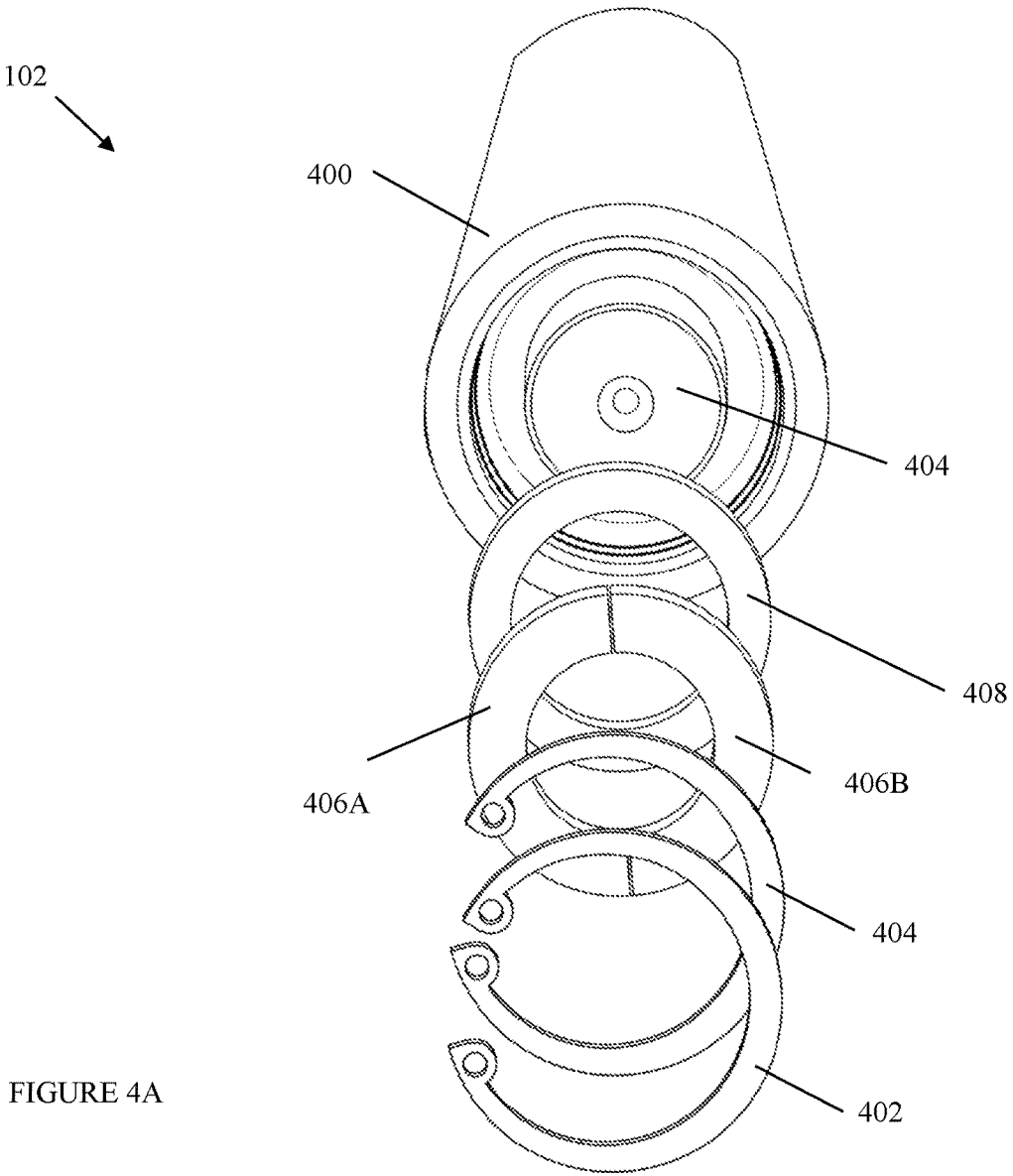
FIG. 4A is an exploded perspective view of a prior art bar sleeve.

Referring now generally to the Figures and particularly to FIG. 4A, FIG. 4A is an exploded perspective view of the invented barbell 102 with a prior art bar sleeve 400 featuring an outer clamp 402 and an inner clamp 404 secure a pair of outer bushing parts 406A and 406B and an inner bushing 408.

Figure 4B:
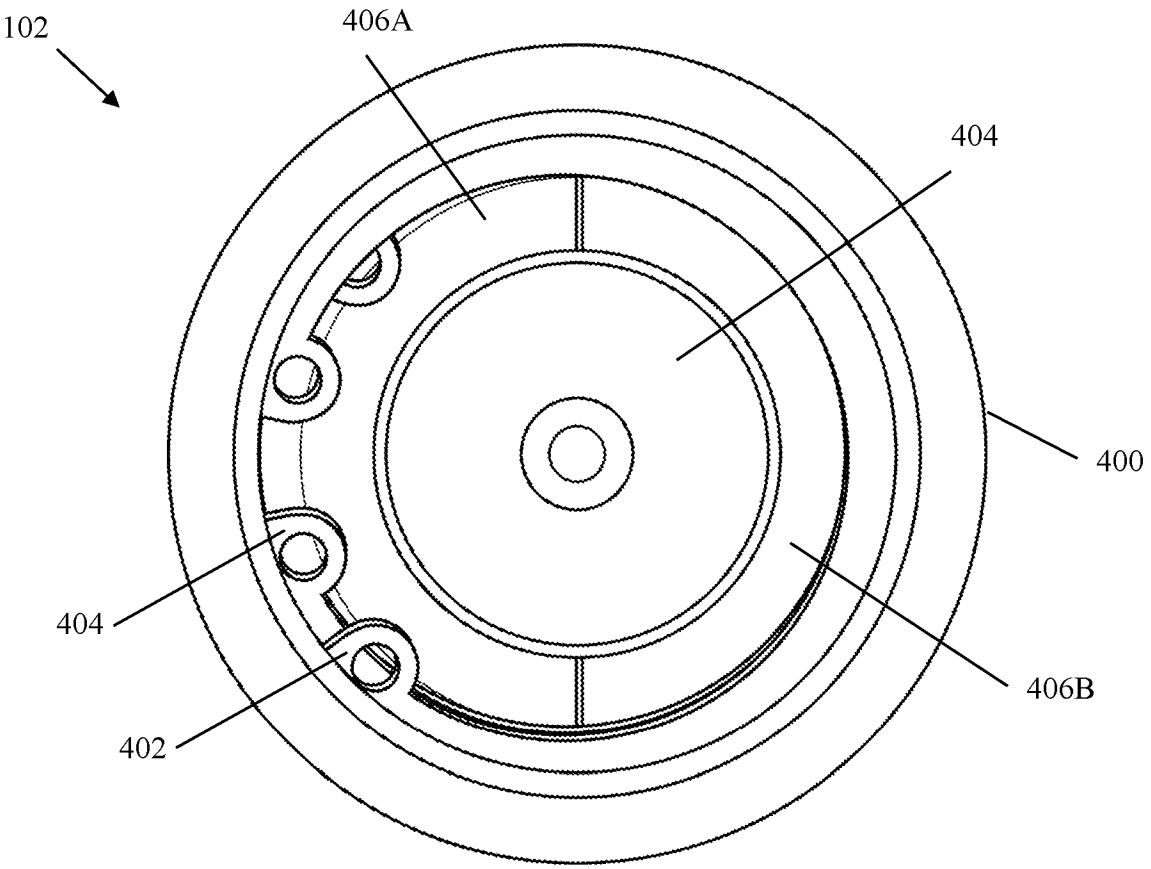
FIGURE 4B (PRIOR ART)
FIG. 4B is a side view of a prior art bar sleeve.

Referring now generally to the Figures and particularly to FIG. 4B, FIG. 4B is a side view of the prior art bar sleeve 400 assembled upon the invented barbell 102.

Figure 4C:
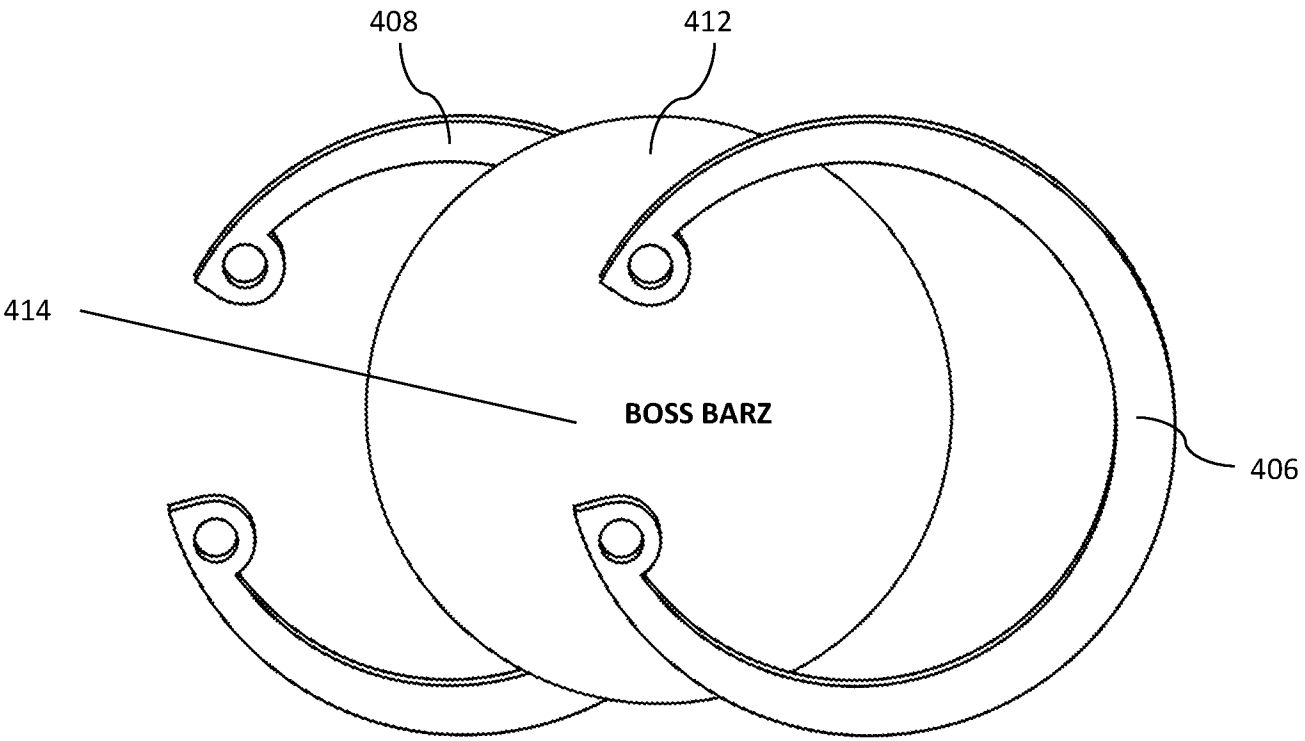
FIG. 4C is a front view where an optional logo plate may be insterted.

Referring now generally to the Figures and particularly to FIG. 4C, FIG. 4C is an exploded perspective view of a signage plate 412 where the optional additional signage plate 412 bearing a visible marking or logo 414 may be inserted. The signage plate 412 is sized and shaped to be held between the outer clamp 406 and the inner clamp 408 when the clamps are installed on the barbell 102.

Figure 5A:
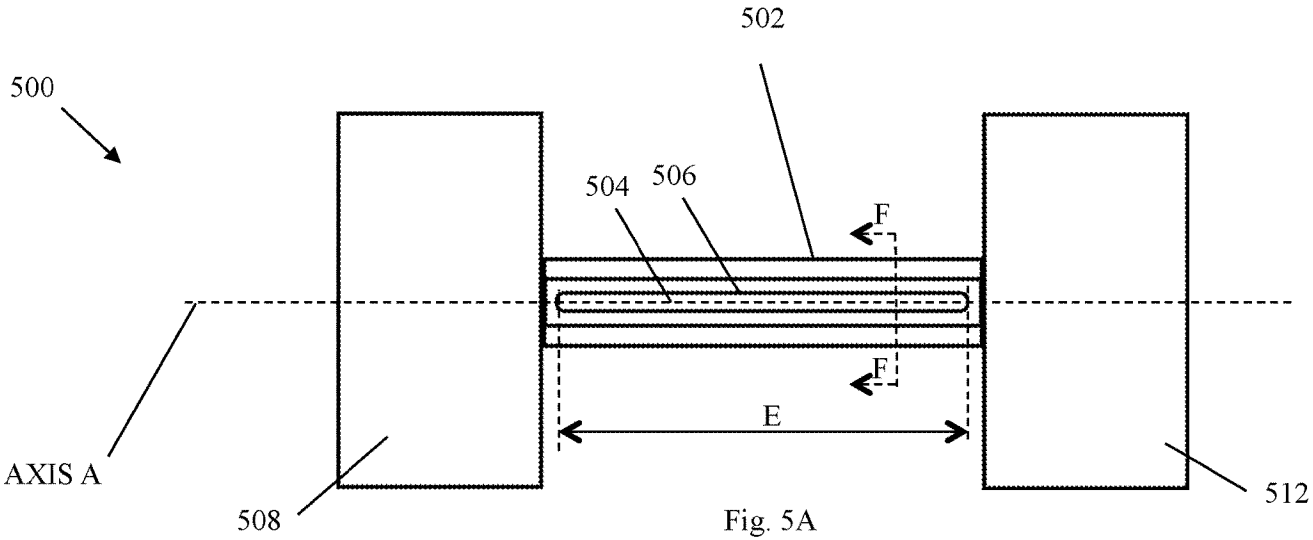
FIG. 5A is a front view of a dumbbell assembly according to a fourth embodiment of an invented dumbbell.

Referring now generally to the Figures and particularly to FIG. 5A, FIG. 5A is a front view of a dumbbell assembly 500 according to an alternate embodiment of an invented dumbbell 502 comprising a fourth plurality of three relieved sections 504, a fourth plurality of six hexagonal sides 506, a fourth pair of weight-carrying sleeves 508 & 512. A cutaway at slice F is used to reference FIG. 5B.

Figure 5B:
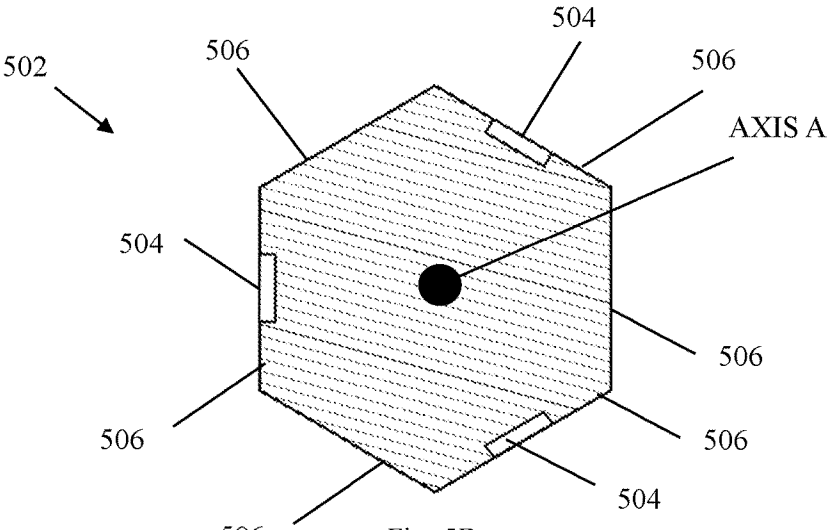
FIG. 5B is a cutaway side-view of the invented dumbbell of FIG. 5A.

Referring now generally to the Figures and particularly to FIG. 5B, FIG. 5B is a cutaway side-view of the invented dumbbell 502 of FIG. 5A clearly depicting relieved sections 504 and hexagonal sides 506.

Figure 6A:
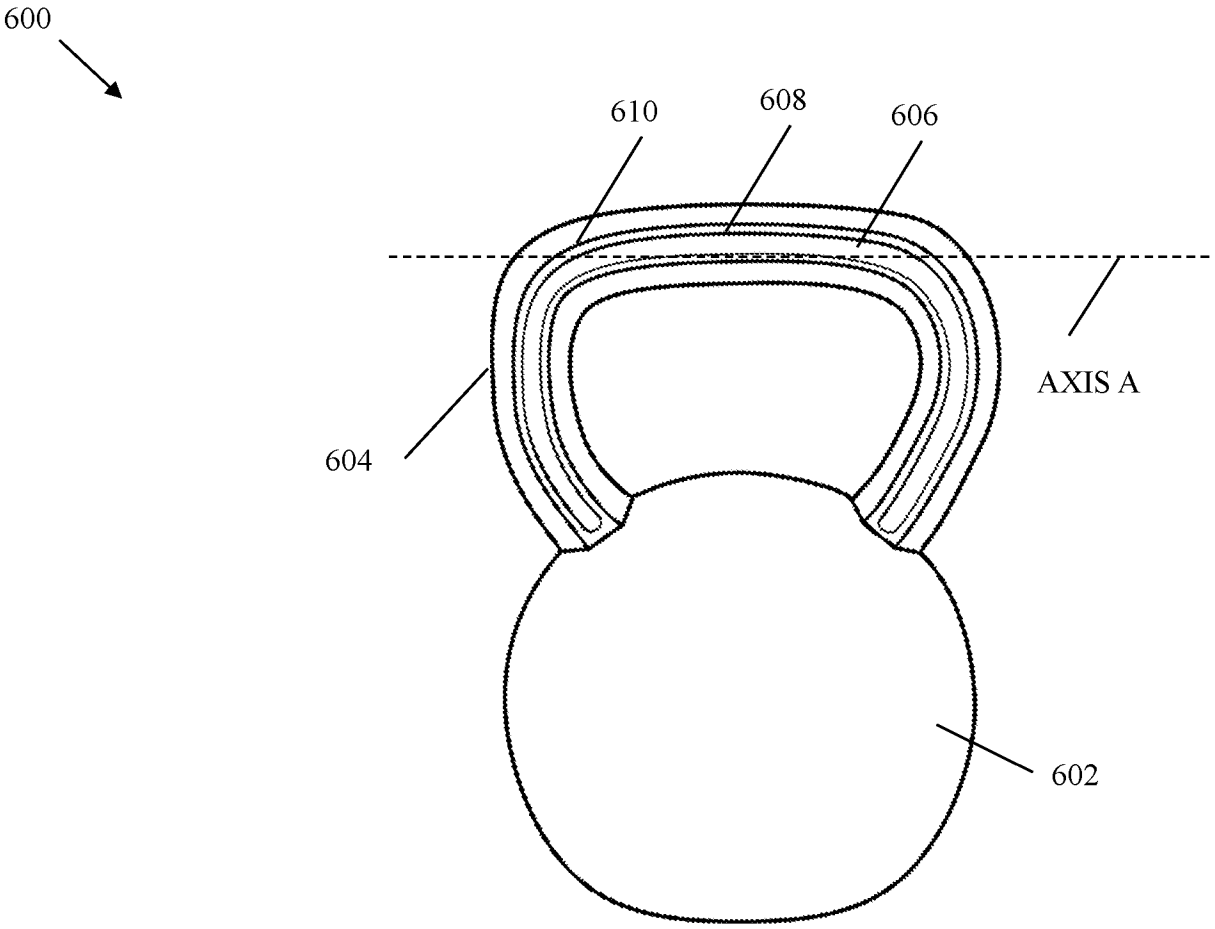
FIG. 6A is a front view of a kettle bell according to a fifth embodiment of an invented barbell.

Referring now generally to the Figures and particularly to FIG. 6A, FIG. 6A is a front view of an invented kettle bell 600 according to an embodiment of an invented kettle bell 602 with invented kettlebell support 604 and kettlebell handle 606. A fifth plurality of six hexagonal sides 608 and additionally or optionally a fifth plurality of three relieved sections 610 extend throughout.

Figure 6B:
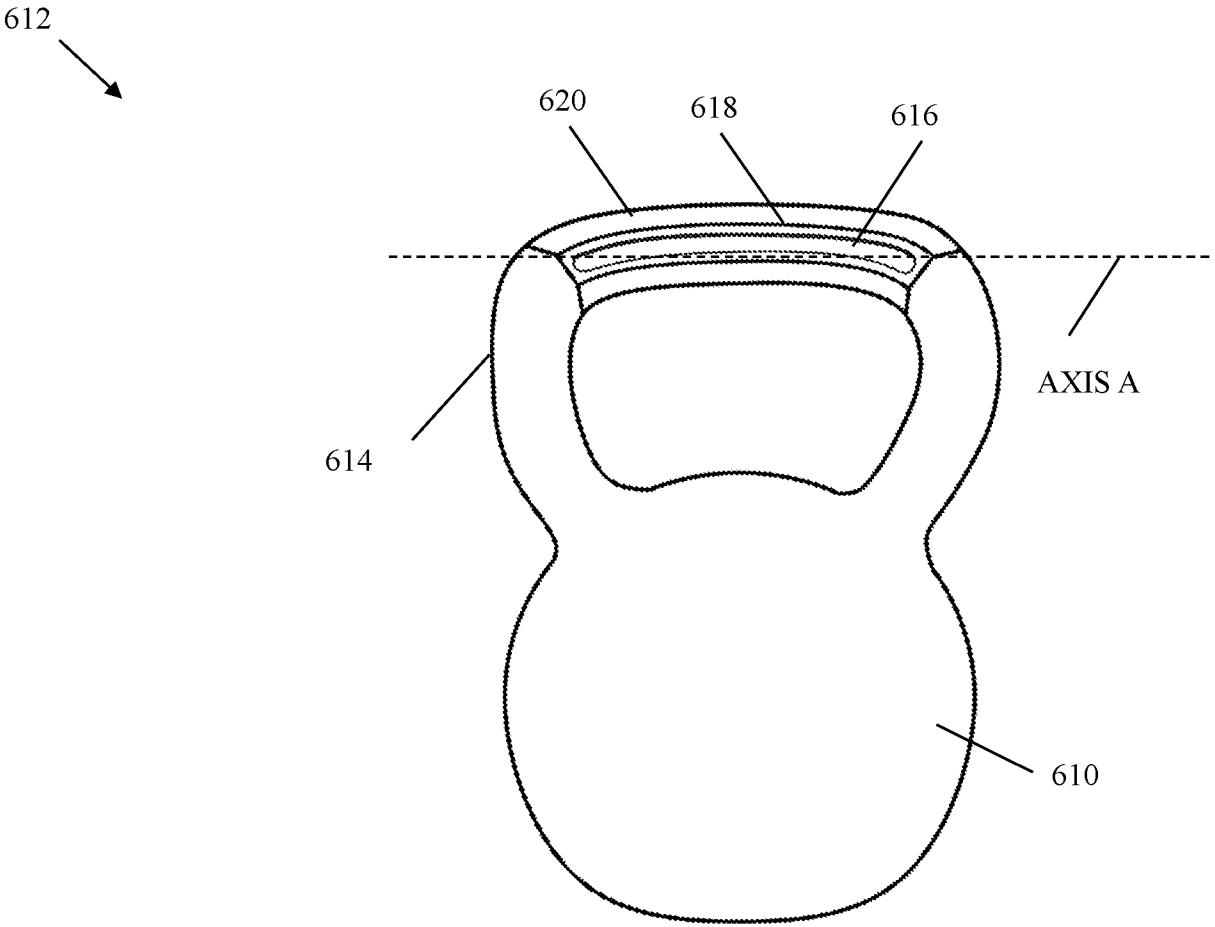
FIG. 6B is a front view of a kettle bell according to a sixth embodiment of an invented barbell.

Referring now generally to the Figures and particularly to FIG. 6B, FIG. 6B is a front view of an alternate embodiment, a second kettle bell 612, featuring a second invented kettle bell support 614; wherein a sixth plurality of six hexagonal sides 616, additionally or optionally present a plurality of three relieved sections 618 that extend throughout a handle 620.

Figure 7:
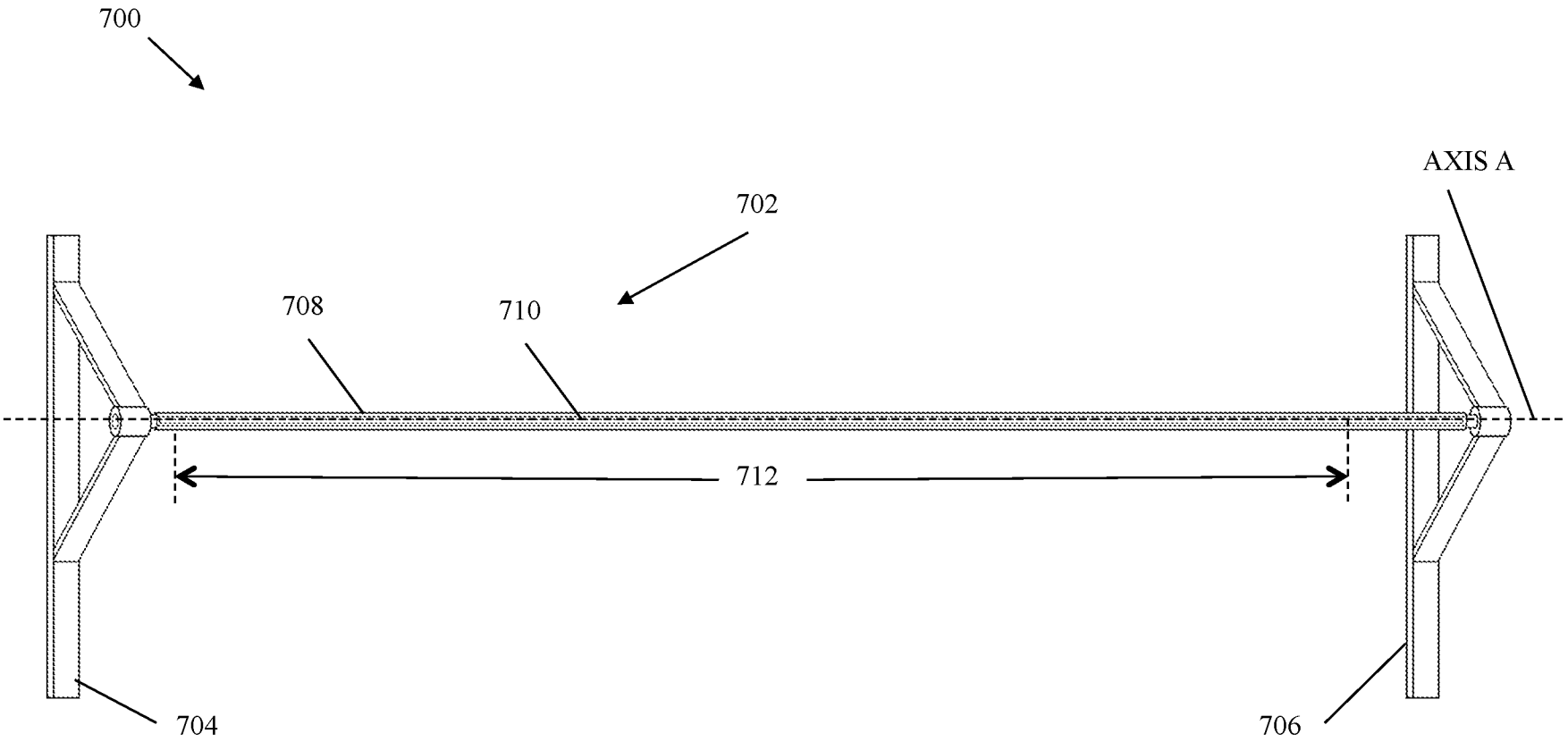
FIG. 7 is a front view of a pull up bar assembly according to a seventh embodiment of an invented barbell; wherein the barbell assembly comprises the barbell and the wall-mounted bar holders.

Referring now generally to the Figures and particularly to FIG. 7, FIG. 7 is a front view of a pull up bar assembly 700 according to an alternate embodiment of an invented pull up bar 702. A pair of wall-mounted bar holders 704 and 706 support the invented pull up bar 702 wherein the invented pull up bar 702 comprises a seventh plurality of six hexagonal sides 708 and optionally a seventh plurality of three relieved sections 710 and/or optionally a knurled length 712.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed.

While selected embodiments have been chosen to illustrate the invented system, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment, it is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

I claim:

1. An exercise bar comprising: a unitary elongate bar comprising an elongate length disposed between a first attachment end and a second attachment end; the first attachment end and the second attachment end each shaped to form a cylindrical cross-section conforming to a standardized weight lifting sleeve specification extending from a center of the bar; the elongate length forming a hexagonal cross-section along at least a first length, thereby forming six elongate sections; three of the six elongate sections being linear relieved sections, each of the three linear relieved sections partially extending along a separate non-adjoining face of the first length, separated by three planar elongate sections of the six elongate sections.

2. The exercise bar of claim 1, the unitary elongate bar further comprising a second length, wherein the second length forms a hexagonal cross-section.

3. The exercise bar of claim 2, wherein the first length and the second length each extend greater than eight inches along the overall length.

4. The exercise bar of claim 3, wherein a first smooth ring portion is disposed within the first length and a second smooth ring portion is disposed within the second length.

5. The exercise bar of claim 2, wherein the first length and the second length are symmetrically positioned relative to a central point of an overall length of the unitary elongate bar.

6. The exercise bar of claim 2, wherein the first length and the second length each extend within the range of from four inches to eight inches along the overall length.

7. The exercise bar of claim 1, wherein the first length extends from the first attachment end and to the second attachment end.

8. The exercise bar of claim 1, wherein a total elongate length of the unitary elongate bar conforms to a standard weight lifting equipment specification.

* * * * *